US006926255B1

(12) United States Patent
Rhodes

(10) Patent No.: US 6,926,255 B1
(45) Date of Patent: Aug. 9, 2005

(54) POOL TABLE SLATE LIFTER

(75) Inventor: Kerry P. Rhodes, Mesilla Park, NM (US)

(73) Assignee: Slatemaster, Inc., Las Cruces, NM (US)

( * ) Notice: Subject to any disclaimer, the term of this patent is extended or adjusted under 35 U.S.C. 154(b) by 163 days.

(21) Appl. No.: 09/977,734

(22) Filed: Oct. 12, 2001

Related U.S. Application Data

(60) Provisional application No. 60/240,261, filed on Oct. 12, 2000.

(51) Int. Cl.[7] ..... B66F 3/36
(52) U.S. Cl. ..... 254/89 R; 254/100
(58) Field of Search ..... 254/269, 89 R, 254/100, 8 R, 47; 474/4; 273/5 B, 3 C, 256; 29/257, 258, 259

(56) References Cited

U.S. PATENT DOCUMENTS

| | | | | |
|---|---|---|---|---|
| 614,763 A | | 11/1898 | Robb et al. | |
| 1,060,103 A | | 4/1913 | Leihy | |
| 1,062,556 A | | 5/1913 | Smith | |
| 1,101,217 A | | 6/1914 | Stamm | |
| 1,273,143 A | | 7/1918 | Bryan | |
| 1,609,625 A | | 12/1926 | Lawes | |
| 2,444,690 A | | 7/1948 | Almendinger et al. | |
| 2,533,999 A | | 12/1950 | Colley | |
| 2,562,189 A | | 7/1951 | Harris | |
| 3,300,186 A | * | 1/1967 | Lee | 254/334 |
| 4,962,913 A | | 10/1990 | Stewart | |
| 5,340,083 A | | 8/1994 | Suhy et al. | |
| 5,456,371 A | * | 10/1995 | Klann | 212/338 |
| 6,464,431 B1 | * | 10/2002 | McNulty | 405/229 |

* cited by examiner

*Primary Examiner*—Robert C. Watson
(74) *Attorney, Agent, or Firm*—Vidal A. Oaxaca; Deborah A. Peacock; Peacock Myers & Adams, P.C.

(57) ABSTRACT

A pool table slate lifter with an adjustable support assembly and a lifting mechanism provided for lifting the entire slate horizontally from the table. Winches are arranged in relation with a power transmission shaft for contemporaneous, synchronous lifting and lowering of both sides of the slate.

140 Claims, 6 Drawing Sheets

POOL TABLE SLATE LIFTER

CROSS-REFERENCE TO RELATED APPLICATIONS

This application claims the benefit of the filing of U.S. Provisional patent application Ser. No. 60/240,261, entitled POOL TABLE SLATE LIFTER, filed on Oct. 12, 2000, and the specification thereof is incorporated herein by reference.

BACKGROUND OF THE INVENTION

1. Field of the Invention (Technical Field)

The present invention relates to pool table or billiard table slate lifters and to the methods of using such lifters.

2. Background Art

Pool and billiard tables are comprised of two main components: a cabinet housing and a slate which forms the actual playing surface. A slate is a unitary, typically rectangular, planar material that is usually composed of a very dense, heavy material. The weight of the slate often causes a structural creep with in the cabinet (sag). Additionally, general use of the table results in wear of a fabric covering the slate. As a result repairs are periodically needed to the table to place shim materials on the various slate supports to accommodate for the sag. Removal of the fabric covering for replacement is also periodically required. These periodic repairs are very difficult to accomplish given the weight and unwieldiness of the slate. In the past, removal of a slate could only be accomplished with the combined manpower of two or more people. The present invention can be used by a single person and does not require the user to exert a great deal of physical force in its operation.

Other than the unwieldy nature of the slate, the slate's configuration and composition presented additional concerns for its manipulation. If any structural deficiencies are present in the slate, the pressures applied by lifting the slate at one point, especially on an angle and on only one side, can result in the cracking or breaking of the slate. Prior art slate lifters such as the device disclosed in U.S. Pat. No. 5,340,083 to Suhy et al., utilize a jack type apparatus that is inserted at one point under the slate and is used to lift the slate from one side. Therefore, the slate is lifted on an angle with the non-lifted side bracing against the cabinet. This type of device is not best suited for lifting a large, heavy planar material such as a slate since the forces exerted at the single lift point could stress the slate resulting in cracking or breaking. The present invention utilizes multiple lift points on opposing sides of the slate thereby minimizing stress to the slate.

The '083 patent device, while accomplishing lift, is unsuitable to allow a single user to lift a slate entirely. The device utilizes only one lift point, requiring the user to operate the device on one side of the table at a time. The slate is lifted and whatever repairs are possible are performed on the lifted side. The slate is then lowered, and the device is disengaged. The device is then moved to the opposite side of the table, and the process begins again. This is a time consuming inconvenience that is avoided by the present invention.

Further, the '083 device, which braces one edge of the slate against the table while lifting the opposing side, may shift at its brace points, requiring the user to hold the slate at all times to prevent slipping. The present invention provides a mechanism that does not require the user to hold the slate in place to prevent possible "slips" that could harm the slate, the table, or the user.

Lifting devices for slabs that are not specifically designed for pool table slates are known in the art. U.S. Pat. No. 4,962,913 to Stewart discloses a device for lifting sidewalk slabs for repair. The device comprises a rigid longitudinal span supported over the sidewalk with cross members. Winches are employed on the cross members to raise hooks disposed on cables. The '913 patent discloses separate winches for each cross member without interrelation other than potentially utilizing adjacent switch operation of each winch or providing a master control switch. Such adjacent switches or even a master switch cannot ensure synchronous, concurrent operation of the winches. As a result, the slab will not be maintained in a horizontal position throughout the lifting process. This destabilizes the load, introducing the potential for loss of the load during the lifting process. The lifting mechanism of the present invention overcomes this problem.

SUMMARY OF THE INVENTION (DISCLOSURE OF THE INVENTION)

The present invention is a lifter that may be used in combination with a pool or billiard table (hereinafter referred to as "pool table" or "table") to easily and safely lift and lower a pool table slate into position on the cabinet frame slate supports. The apparatus utilizes a frame comprising at least four side support brackets which each having an upper end and a lower end and at least two cross support beams which have opposing ends. The cross support beams are connected to the side support brackets near or at the upper ends of the brackets and near or at the opposing ends of the cross support beams. This places the beams and brackets in a perpendicular position relative to one another.

The present invention has support brackets with an upper assembly on their upper ends, including a support frame opening provided for inserting the cross beams therethrough.

The lifter may additionally include upper and lower crossbeam guides adjacent to the opening. A support bracket brace with a side support frame hole for receipt of a crossbeam table width adjustment pin may also be provided. The cross support beams may comprise a plurality of adjustment holes disposed near each of the opposing ends of the beam for receipt of the crossbeam table width adjustment pin.

The lifter also has raising and lowering mechanism comprising winches, a power transmission shaft, drop pulleys, cables, and slate clamps. Alternate mechanisms for lifting such as hydraulic systems may be utilized. A winch is provided at an approximate midpoint of each cross support beam. The winch utilized is preferably a drum winch. The winch nearest the power source comprises a master winch; the other winches are slave winches. A non-circular transmission shaft is disposed through each winch and torque applied to the shaft is transferred to the winch. The winches have at least one cable, which has opposite ends, disposed through each winch. The cable is also threaded through at least one pulley. These drop pulleys are disposed at points on the cross support beams which are interposed between a midpoint of the cross support beams and a point of intersection of the beams and the support brackets. At least two drop pulleys are disposed on each cross support beam. At least one spring loaded hook is attached to each protruding end of the cable. The hooks are engaged with the slate, preferably at points correlating to the positioning of pockets within the frame of the table. A power source is connected to a near end of the transmission shaft and is capable of applying torque to the shaft which is then transferred to the winches for raising and lowering the slate. The power source is preferably a motor, however other sources capable of torquing a shaft, including a manually generated force, may be utilized.

In a case where a manually generated force is utilized as the power source, the lifter preferably further includes a worm gear disposed at a near end of the power transmission shaft. The gear has a noncircular bore which is attachable to the transmission shaft in a manner sufficient to provide a transfer of the torque to the shaft. The torque is provided by operation of a crank handle having a crank end and a connection end. The handle is connected to a worm at the connection end, and the worm is positioned in relationship to the worm gear to transfer torque from the crank handle to the worm gear and finally to the transmission shaft.

The present invention adjusts to multiple table sizes, where the height of the support brackets, the length of the transmission shaft, and the length of the cross support beams are adjustable. The lifter preferably comprises six brackets and three beams. However, other configurations having at least four brackets and two beams are also within the scope of the present invention.

Stabilizing devices may be utilized, including a clamp on the support bracket for attachment to a table. A leg extension may extend below the upper surface of the cabinet frame of a pool table. A support foot may be attached to and adjacent the lower end of the support bracket. Side support beams may be attached in a perpendicular planar configuration with the brackets which may be adjustably connected to the brackets so that the overall length of the apparatus is adjustable.

The slate lifter is preferably used in combination with a pool table. The slate lifter comprises side support brackets having a lower end which has a bottom surface that rests on an upper edge of the cabinet frame of the pool table.

The present invention further comprises a method of operating a slate lifter by placing a bottom surface of the side support brackets on an upper edge of a pool table cabinet. The height of the side support brackets is adjusted, as is the length of the power transmission shaft and cross support beams. These positions are then fixed into place, and slate hooks are attached under a bottom surface edge of the table in relationship with the pockets. A torque force is applied to the transmission shaft and is contemporaneously transferred from the shaft to a master winch and at least one slave winch to provide synchronous movement. Finally, a cable attached to the slate hooks and threaded through the winch and pulleys is winched to either raise or lower the slate.

A primary object of the present invention is to provide a slate lifter that lifts a pool table slate.

Another object of the present invention is to provide a stable slate lifter that can be attached to a pool table.

A further object of the present invention is to provide a slate lifter that is easily operated either manually or through power devices.

Another object of the present invention is to provide a slate lifter that does not require great physical strength in the user.

A further object of the present invention is to provide a slate lifter that does not place undue stress on the slate or to the pool table cabinet.

Yet another object of the present invention is to provide a slate lifter that is easily storable.

Another object of the present invention is to provide a slate lifter that is adjustable to different sizes of tables and slates.

A primary advantage of the present invention is the ability to lift a slate and keep it horizontal, thereby reducing stress on the slate and allowing a user to repair either the slate covering or table on opposing sides of the table without additional operations.

Another advantage of the present invention is the easy assembly, storage, and use of the invention.

Yet another advantage of the invention is the adjustability of the invention to the length and width parameters of tables of differing size.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DESCRIPTION OF THE PREFERRED EMBODIMENTS (BEST MODES FOR CARRYING OUT THE INVENTION

The present invention is a lifter and method for its use. It is particularly useful for lifting slates from pool tables. It comprises a support assembly for stabilizing a lifting mechanism over a slate. The support assembly, typically comprising side support brackets and cross support beams, is preferably adjustably connected to accommodate various sizes of tables. Additional side support beams and stabilization members, including bracket feet, leg extensions, or clamps, may be utilized to hold the apparatus solidly on the table cabinet frame. The lifting mechanism preferably includes a non-circular transmission shaft connecting a series of winches disposed on cross beams. The winches are threaded with cables attached to clamps which hold the slate and winch the cables to raise or lower the slate. The invention may also utilize other lifting mechanisms such as a hydraulic system.

Reference is now made to the drawings which illustrate embodiments of the present invention.

Figure 1:
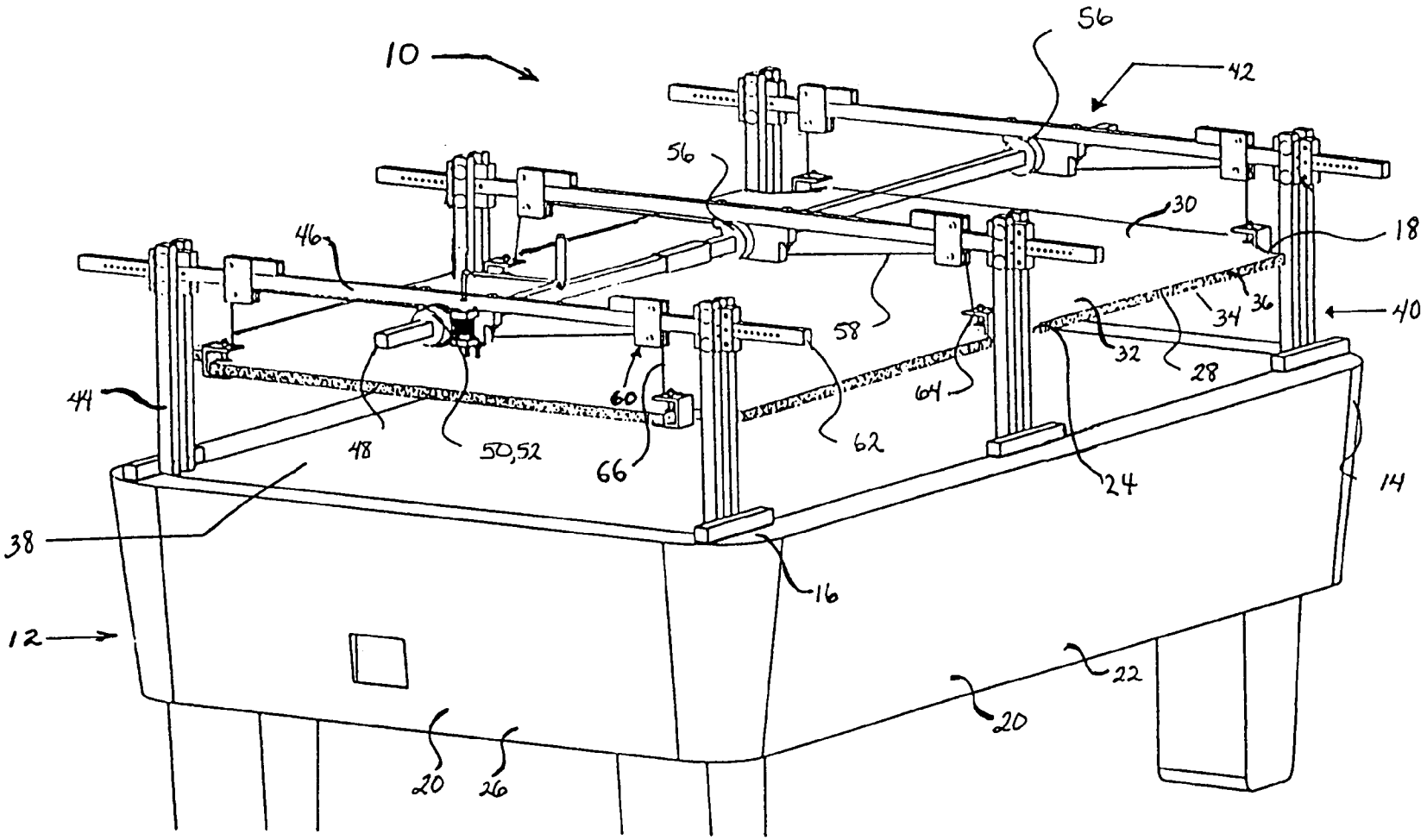
FIG. 1 is perspective view depicting the slate lifter of the present invention used with a standard pool table.

FIG. 1 is a perspective view depicting pool table slate lifter 10 that is preferably used in combination with pool table 12 preferably having generally rectangular cabinet frame 14 with four corners 16, having corner pocket 18 disposed at each corner, and four side walls 20 comprising two longer side walls 22, having at least one side pocket 24 disposed approximately at a midpoint on each of longer side walls 22, and two shorter side walls 26. The table also has slate 28 comprising playing surface 30, having upper surface 32, lower surface 34, and four edges 36. The lifter apparatus of the present invention is useful for lifting and lowering slate 28 vertically while keeping it in a relatively horizontal position. Additionally, the apparatus of the present invention does not require tilting the slate to gain access to the underside of the slate or interior 38 of cabinet 14.

FIG. 1 depicts a preferred embodiment of slate lifter 10 having support assembly 40 and lifting mechanism 42. Support assembly 40 preferably comprises six upright brackets 44 and three cross beams 46. Differing numbers of brackets and cross beams are utilized, but it is preferable to use at least four brackets and two cross beams for stability of the apparatus. Both upright brackets 44 and cross beams 46 are detachable from lifter 10 to allow for adjustability of the apparatus. Brackets 44 and beams 46 comprise a suitably rigid material to support the weight of slate 28. Preferably the material is a metal, and more preferably steel is utilized for its strength and light weight. Lifting mechanism 42 comprises power transmission shaft 48 in perpendicular arrangement with cross beams 46 and disposed through winches 50. Master winch 52 is preferably disposed nearer power source 54 than slave winches 56. All winches 50 are disposed approximately at a midpoint of cross beams 46. Winches 50 are preferably drum winches and operate in a reversible manner. Additionally, it is preferred to have winches which will not release the cable without utilizing a manual release switch, thereby preventing the slate from falling if the winching action is halted. Winches 50 have at least one cable 58 threaded therethrough. Cable 58 is additionally threaded through at least one pulley 60. Pulley 60 is preferably a drop pulley. Additionally, each cross beam 46 has at least two pulleys 60. Each pulley 60 is interposed at a point between the midpoint of cross beam 46 and ends 62 of cross beam 46. Each cable 58 has a clamp 64 attached to its at least one protruding end 66. Clamps 64 are preferably spring loaded clamps. Clamps 64 are attached to slate 28, preferably at points corresponding to pockets 18, 24.

Figure 2:
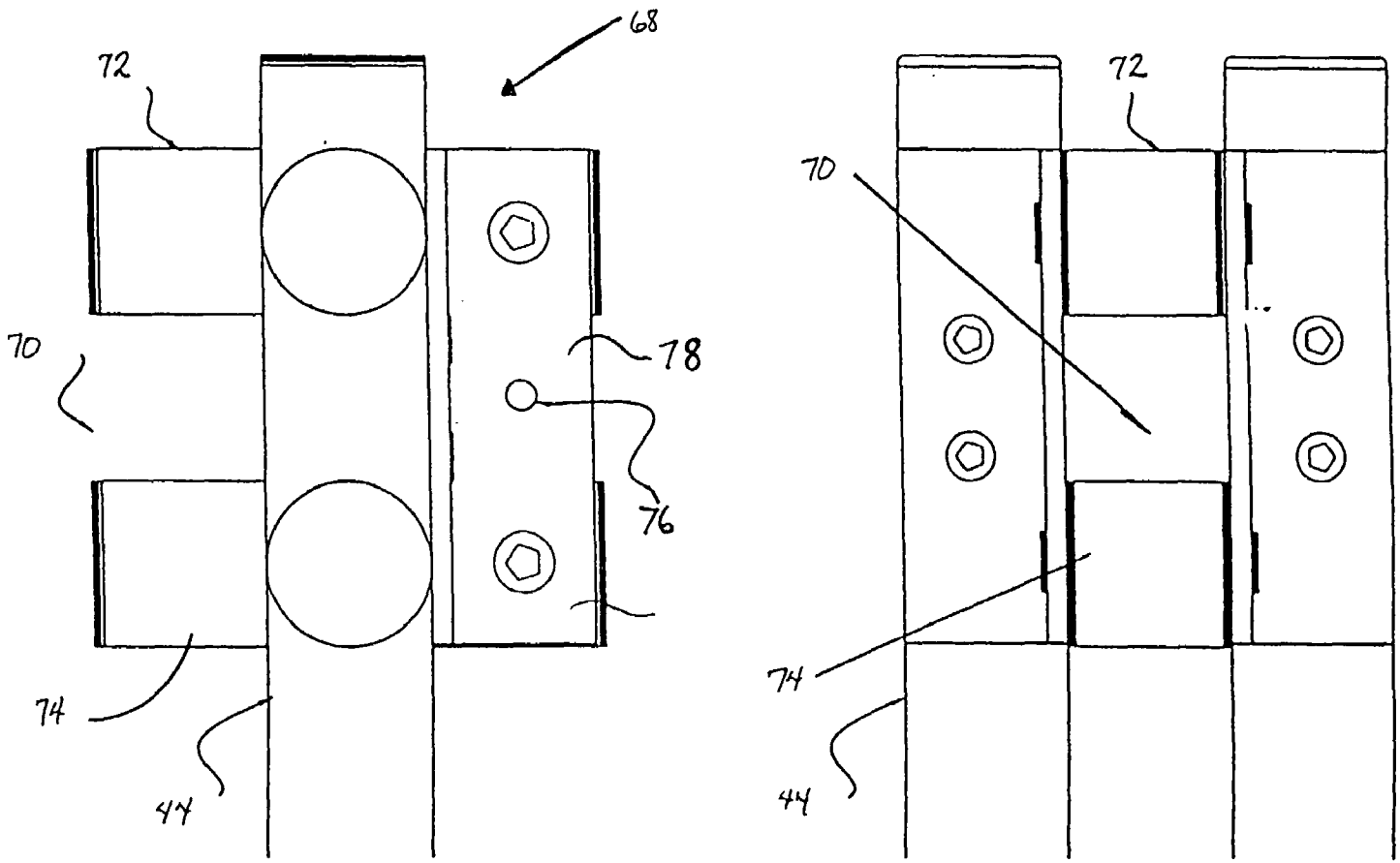
FIG. 2 is a side view of an upper assembly of the side support brackets for connection with the cross support beams.

FIG. 2 is a side view of brackets 44 which preferably comprise upper assembly 68 for connection with cross beams 46. Upper assembly 68 comprises support frame opening 70 for inserting cross beams 46 therethrough. Upper assembly 68 additionally comprises upper crossbeam guides 72 and lower crossbeam guides 74 adjacent opening 70. Further depicted is adjustment hole 76 on side support bracket brace 78 for receipt of pin 80 for connection with crossbeams 46.

Figure 3:
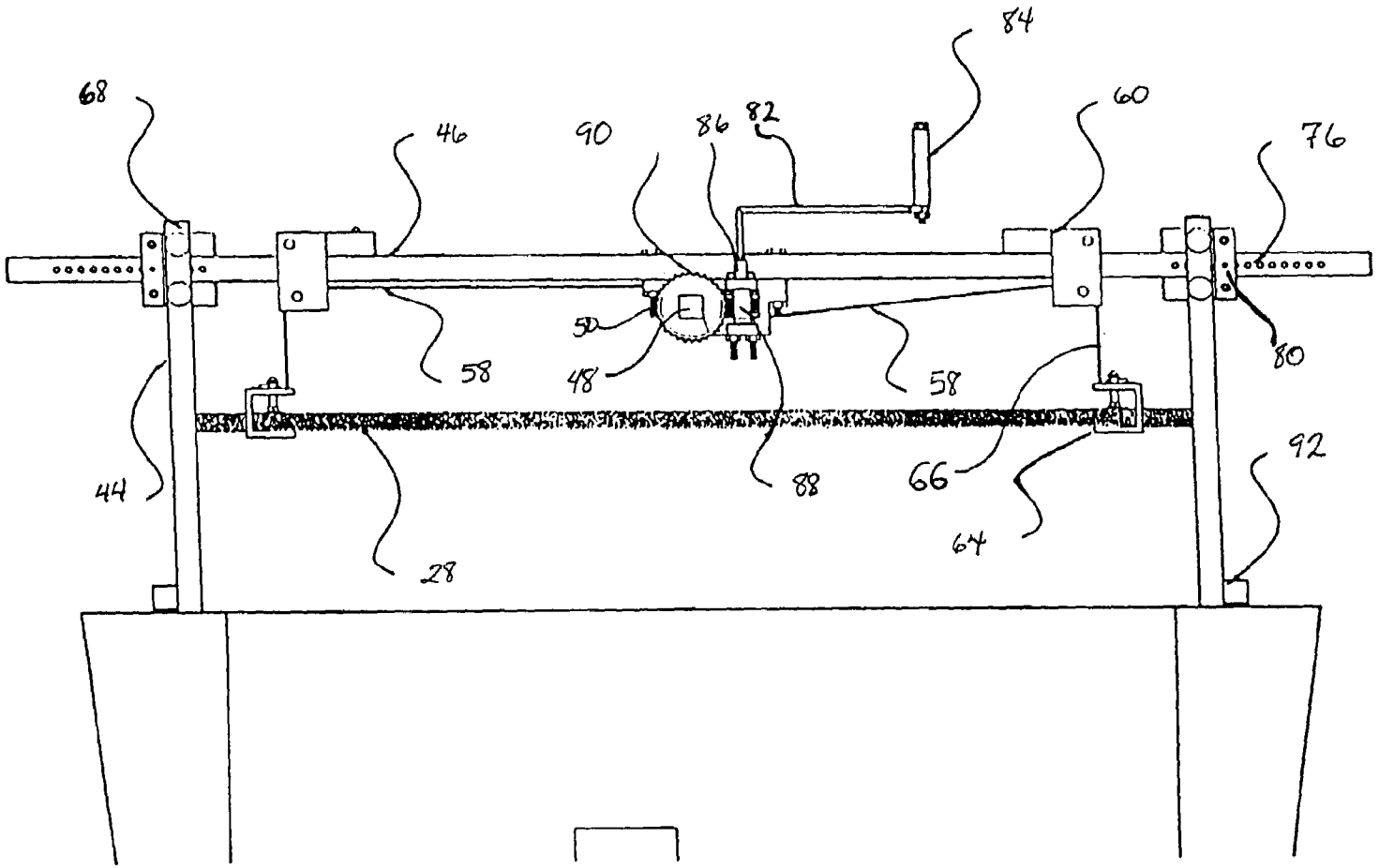
FIG. 3 is a end view of the slate lifter illustrating the support assembly and lifting mechanism.

FIG. 3 is an end view illustrating support assembly 40 and lifting mechanism 42. The invention utilizes crank 82, having crank end 84 and connection end 86 for effecting manual power source 54. Connection end 86 is connected to worm 88 which is in relationship with worm gear 90 sufficient to transfer torque from crank 82 to worm gear 90. Worm gear 90 turns, thereby torquing power transmission shaft 48. Power transmission shaft 48 is disposed through winches 50. FIG. 3 depicts drum winch 50 with cable 58 threaded therethrough. Cable 58 is additionally threaded through drop pulley 60 and has spring loaded clamps 64 attached to each end 66. FIG. 3 further depicts cross beams 46 inserted through opening 70 of bracket 44 and utilizing plurality of adjustment holes 76 with pin 80 for connection. Further depicted is foot 92 on bracket 44 for added stability. Other stability devices may be utilized in further embodiments, including clamps and leg extensions.

Figure 4:
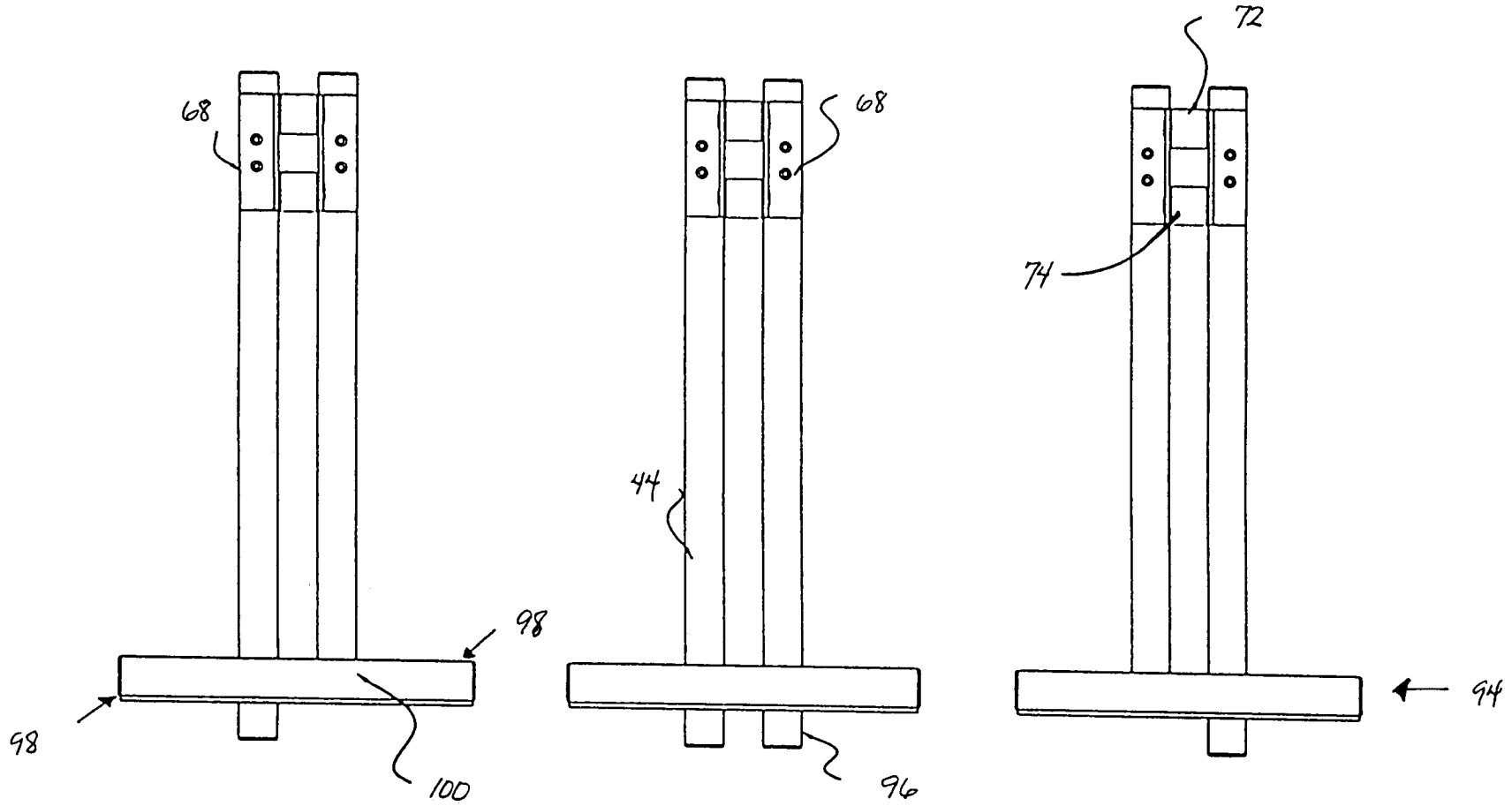
FIG. 4 is a side view of the side support brackets illustrating the upper assembly and a lower assembly for supporting and stabilizing the apparatus.

FIG. 4 is a side view of brackets 44 depicting upper assembly 68 for connection with cross beams 46 and lower assembly 94 utilizing leg extensions 96. Upper assembly 68 provides upper guide 72 and lower guide 74 for receipt of cross beam 46. Lower assembly 94 provides leg extensions 96 for stability. Two extensions 96 are preferably utilized, however, other extension embodiments may be used, including embodiments having only one extension. The diagram shows two embodiments each utilizing one extension 96 on opposing ends 98 of bracket base 100 and an embodiment utilizing two extensions 96.

Figure 5:
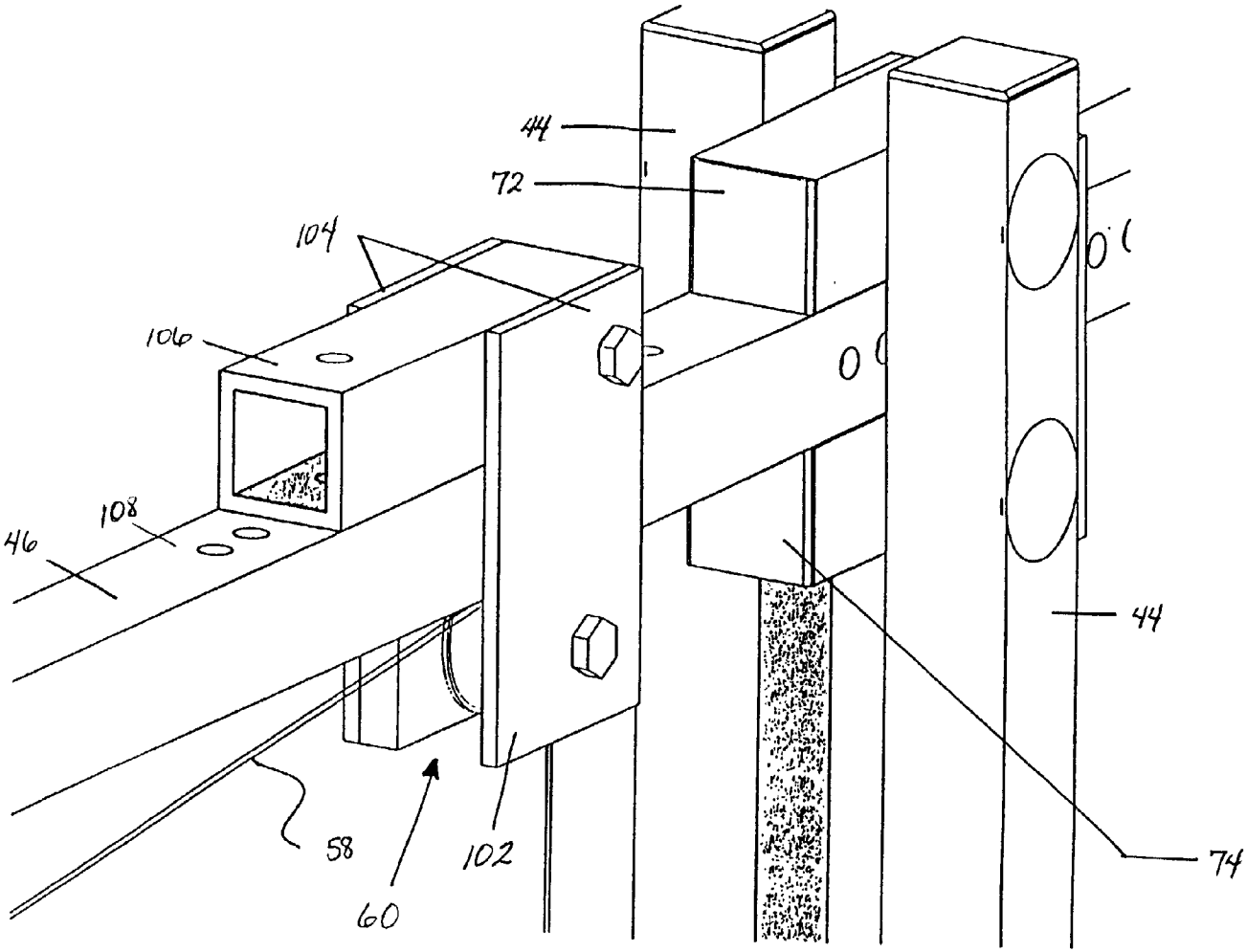
FIG. 5 is a perspective view of the intersection of the cross beams and support brackets, additionally depicting a pulley on the cross beam.

FIG. 5 is a perspective view depicting the intersection of the brackets 44 and beams 46 and pulley 60. Beam 46 is inserted through opening 70 of upper assembly 68 of bracket 44. Housing 102 of pulley 60 is comprised of at least two side plates 104 having a pulley housing upper crossbeam guide 106, interposed therebetween. The guide 106 rests on an upper surface 108 of cross beam 46 for disposal along beam 46 at a desired point. Cable 58 is threadedly engage through pulley 60. One end of the threaded cable 58 is further disposed through winch 50 and the other is engaged by clamp 64. Preferably, one cable 58 extends between two clamps 64 disposed through two pulleys 60 with engagement in an interposed winch 50 therebetween (See FIG. 1).

Figure 6:
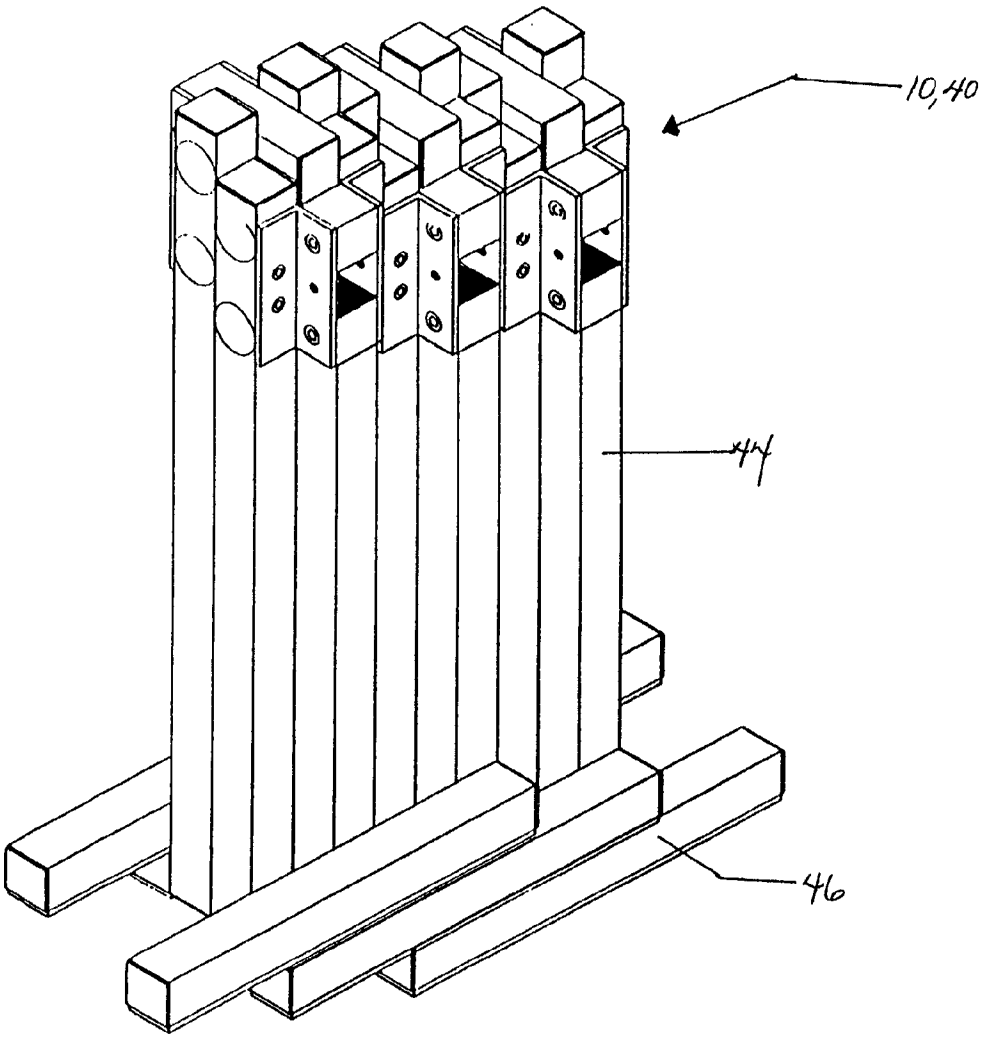
FIG. 6 is a perspective view of the lifter folded for storage.

FIG. 6 is a perspective view support assembly 40 of slate lifter 10 in its storable configuration. Depicted are brackets 44 in an upright position with beams 46 in a horizontal position to brackets 44. The adjustable connected nature of the apparatus, as depicted here with a pin and hole connection, supports such a configuration.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference. The invention is not limited to lifting slates from pool tables; it can be used for lifting any applicable surface.

What is claimed is:

1. A lifter comprising:

at least four side support brackets, each said side support bracket comprising an upper end and a lower end;

at least two cross support beams, each said beam comprising an adjustable length and opposing ends and connectedly disposed to said side support brackets;

a lifting mechanism comprising a transmission shaft and at least one clamp or hook for attachment to a slate surface, said transmission shaft connecting said at least two cross support beams; and a power source connected to said transmission shaft capable of applying torque to said transmission shaft.

2. The lifter of claim 1 wherein each said cross support beam is in proximate relationship with said upper end of two said side support brackets.

3. The lifter of claim 1 wherein each said cross support beam is disposed in a perpendicular relationship to said side support brackets.

4. The lifter of claim 1 wherein a height of said side support brackets is adjustable.

5. The lifter of claim 1 wherein a length of said transmission shaft is adjustable.

6. The lifter of claim 1 comprising six side support brackets.

7. The lifter of claim 5 comprising three cross support beams.

8. The lifter of claim 1 wherein said support brackets additionally comprise a leg extension to extend below an upper surface of a cabinet frame.

9. The lifter of claim 1 wherein said side support brackets additionally comprise a support foot attached to and adjacent said lower end of said side support brackets.

10. The lifter of claim 1 additionally comprising side support beams attached in perpendicular planar configuration with said side support brackets.

11. The lifter of claim 10 wherein said side support beams are adjustably connected to said side support brackets wherein said overall length of said lifter is thereby adjustable.

12. The lifter of claim 1 wherein said side support brackets comprise an upper assembly having a support frame opening provided for inserting one of said cross beams therethrough.

13. The lifter of claim 11 wherein said side support brackets additionally comprise upper and lower cross beam guides adjacent said opening.

14. The lifter of claim 11 additionally comprising a side support bracket brace having a side support frame hole for receipt of a cross beam table width adjustment pin.

15. The lifter of claim 14 wherein said cross support beams comprise a plurality of adjustment holes disposed near each of said opposing ends for receipt of said cross beam table width adjustment pin.

16. The lifter of claim 1 wherein said cross support beams and said side support brackets are foldable in a storage configuration.

17. The lifter of claim 1 wherein said lifting mechanism comprises:

at least one winch;

said transmission shaft disposed through said at least one winch;

a plurality of pulleys;

at least one cable running through each of said pulleys and through said at least one winch, said cable having opposing ends; and said at least one clamp or hook attached to at least one said end of each said cable.

18. The lifter of claim 17 wherein said transmission shaft is non-circular.

19. The lifter of claim 17 wherein said pulleys comprise drop pulleys.

20. The lifter of claim 17 wherein said at least one clamp or hook comprises a spring loaded clamp or hook.

21. The lifter of claim 17 wherein said at least one winch is disposed at an approximate midpoint of at least one of said cross support beams.

22. The lifter of claim 21 wherein said plurality of pulleys are disposed at points on said cross support beams interposed between said midpoint of said cross support beams and a point of intersection of said cross support beams and said side support brackets.

23. The lifter of claim 22 wherein at least two pulleys are disposed on each said cross support beam.

24. The lifter of claim 17 wherein said at least one cable is disposed through said at least one winch and at least one pulley.

25. The lifter of claim 17 wherein said transmission shaft comprises a near end connected to said power source.

26. The lifter of claim 17 wherein said power source for torquing said shaft is selected from the group consisting of a motor and a manually generated force.

27. The lifter of claim 17 further comprising:

a worm gear disposed at a near end of said power transmission shaft;

a noncircular bore formed in said worm gear, said bore attachable to said transmission shaft in a manner to provide transfer of torque to said shaft;

a worm;

a crank handle having a crank end and a connection end, said handle attached to said worm at said connection end; and said worm positioned in relationship to said worm gear to transfer torque from said crank handle to said worm gear.

28. The lifter of claim 17 wherein said at least one winch comprises a double drum winch.

29. The lifter of claim 17 wherein one of said at least one winch disposed nearest said power source comprises a master winch.

30. The lifter of claim 17 wherein said at least one winch has an internal mechanism preventing reverse movement of said cable without engaging a manual release switch.

31. A lifter comprising:

at least four side support brackets, each said side support bracket comprising an upper end, a lower end, and a leg extension to extend below an upper surface of a cabinet frame;

at least two cross support beam beams, each said beam comprising an adjustable length and opposing ends, and connectedly disposed to said side support brackets;

a lifting mechanism comprising a transmission shaft, said transmission shaft connecting said at least two cross support beams; and a power source connected to said transmission shaft capable of applying torque to said shaft.

32. The lifter of claim 31 wherein each said cross support beam is in proximate relationship with said upper end of two said side support brackets.

33. The lifter of claim 31 wherein each said cross support beam is disposed in a perpendicular relationship to said side support brackets.

34. The lifter of claim 31 wherein a height of said side support brackets is adjustable.

35. The lifter of claim 31 wherein a length of said transmission shaft is adjustable.

36. The lifter of claim 31 comprising six brackets.

37. The lifter of claim 35 comprising three cross support beams.

38. The lifter of claim 31 wherein said side support brackets additionally comprise a support foot attached to and adjacent said lower end of said side support brackets.

39. The lifter of claim 31 additionally comprising side support beams attached in perpendicular planar configuration with said side support brackets.

40. The lifter of claim 39 wherein said side support beams are adjustably connected to said side support brackets wherein said overall length of said lifter is thereby adjustable.

41. The lifter of claim 31 wherein said side support brackets comprise an upper assembly having a support frame opening provided for inserting one of said cross support beams therethrough.

42. The lifter of claim 41 wherein said side support brackets additionally comprise upper and lower cross beam guides adjacent said opening.

43. The lifter of claim 41 additionally comprising a side support bracket brace having a side support frame hole for receipt of a cross beam table width adjustment pin.

44. The lifter of claim 43 wherein said cross support beams comprise a plurality of adjustment holes disposed near each of said opposing ends for receipt of said cross beam table width adjustment pin.

45. The lifter of claim 31 wherein said cross support beams and said side support brackets are foldable in a storage configuration.

46. The lifter of claim 31 wherein said lifting mechanism comprises:

at least one winch;

said transmission shaft disposed through said at least one winch;

a plurality of pulleys;

at least one cable running through each of said pulleys and through sat at least one winch, said at least one cable having opposing ends; and at least one clamp or hook attached to at least one of said ends of each said cable.

47. The lifter of claim 46 wherein said transmission shaft is non-circular.

48. The lifter of claim 46 wherein said pulleys comprise drop pulleys.

49. The lifter of claim 46 wherein said at least one clamp or hook comprises a spring loaded clamp or hook.

50. The lifter of claim 46 wherein said at least one winch is disposed at an approximate midpoint of at least one of said cross support beams.

51. The lifter of claim 50 wherein said plurality of pulleys are disposed at points on said cross support beams interposed between said midpoint of said cross support beams and a point of intersection of said cross support beams and said side support brackets.

52. The lifter of claim 51 wherein at least two pulleys are disposed on each said cross support beam.

53. The lifter of claim 46 wherein said at least one cable is disposed through said at least one winch and at least one pulley.

54. The lifter of claim 46 wherein said transmission shaft comprises a near end connected to said power source.

55. The lifter of claim 46 wherein said power source for torquing said shaft is selected from the group consisting of a motor and a manually generated force.

56. The lifter of claim 46 further comprising:

a worm gear disposed at a near end of said power transmission shaft;

a noncircular bore formed in said worm gear, said bore attachable to said transmission shaft in a manner to provide transfer of torque to said shaft;

a worm;

a crank handle having a crank end and a connection end, said handle attached to said worm at said connection end;

said worm positioned in relationship to said worm gear to transfer torque from said crank handle to said worm gear.

57. The lifter of claim 46 wherein said at least one winch comprises a double drum winch.

58. The lifter of claim 46 wherein one of said at least one winch disposed nearest said power source comprises a master winch.

59. The lifter of claim 46 wherein said at least one winch has an internal mechanism preventing reverse movement of said cable without engaging a manual release switch.

60. A lifter comprising:

at least four side support brackets each said side support bracket comprising an upper end, a lower end, and a support foot attached to and adjacent said lower end;

at least two cross support beam beams, each said beam comprising an adjustable length and opposing ends, and connectedly disposed to said side support brackets;

a lifting mechanism comprising a transmission shaft, said transmission shaft connecting said at least two cross support beams; and a power source connected to said transmission shaft capable of applying torque to said shaft.

61. The lifter of claim 60 wherein each said cross support beam is in proximate relationship with said upper end of two said side support brackets.

62. The lifter of claim 60 wherein each said cross support beam is disposed in a perpendicular relationship to said side support brackets.

63. The lifter of claim 60 wherein a height of said support brackets is adjustable.

64. The lifter of claim 60 wherein a length of said transmission shaft is adjustable.

65. The lifter of claim 60 comprising six side support brackets.

66. The lifter of claim 64 comprising three cross support beams.

67. The lifter of claim 60 additionally comprising side support beams attached in perpendicular planar configuration with said side support brackets.

68. The lifter of claim 67 wherein said side support beams are adjustably connected to said side support brackets wherein said overall length of said lifter is thereby adjustable.

69. The lifter of claim 60 wherein said side support brackets comprise an upper assembly having a support frame opening provided for inserting one of said cross support beams therethrough.

70. The lifter of claim 68 wherein said side support brackets additionally comprise upper and lower cross beam guides adjacent said opening.

71. The lifter of claim 68 additionally comprising a side support bracket brace having a side support frame hole for receipt of a cross beam table width adjustment pin.

72. The lifter of claim 71 wherein said cross support beams comprise a plurality of adjustment holes disposed near each of said opposing ends for receipt of said cross beam table width adjustment pin.

73. The lifter of claim 60 wherein said cross support beams and said side support brackets are foldable in a storage configuration.

74. The lifter of claim 60 wherein said lifting mechanism comprises:

at least one winch;

said transmission shaft disposed through said at least one winch;

a plurality of pulleys;

at least one cable running through each of said pulleys and through sat at least one winch, said at least one cable having opposing ends; and at least one clamp or hook attached to at least one of said ends of each said cable.

75. The lifter of claim 60 wherein said transmission shaft is non-circular.

76. The lifter of claim 60 wherein said pulleys comprise drop pulleys.

77. The lifter of claim 60 wherein said at least one clamp or hook comprises a spring loaded clamp or hook.

78. The lifter of claim 60 wherein said at least one winch is disposed at an approximate midpoint of at least one of said cross support beams.

79. The lifter of claim 78 wherein said plurality of pulleys are disposed at points on said cross support beams interposed between said midpoint of said cross support beams and a point of intersection of said cross support beams and said side support brackets.

80. The lifter of claim 79 wherein at least two pulleys are disposed on each said cross support beam.

81. The lifter of claim 60 wherein said at least one cable is disposed through said at least one winch and at least one pulley.

82. The lifter of claim 60 wherein said transmission shaft comprises a near end connected to said power source.

83. The lifter of claim 60 wherein said power source for torquing said shaft is selected from the group consisting of a motor and a manually generated force.

84. The lifter of claim 60 further comprising:

a worm gear disposed at a near end of said power transmission shaft;

a noncircular bore formed in said worm gear, said bore attachable to said transmission shaft in a manner to provide transfer of torque to said shaft;

a worm;

a crank handle having a crank end and a connection end, said handle attached to said worm at said connection end;

said worm positioned in relationship to said worm gear to transfer torque from said crank handle to said worm gear.

85. The lifter of claim 60 wherein said at least one winch comprises a double drum winch.

86. The lifter of claim 60 wherein one of said at least one winch disposed nearest said power source comprises a master winch.

87. The lifter of claim 60 wherein said at least one winch has an internal mechanism preventing reverse movement of said cable without engaging a manual release switch.

88. A lifter comprising:

at least four side support brackets, each said bracket comprising an upper end, a lower end, and an upper assembly having a support frame opening provided for inserting at least one cross beam therethrough;

each said cross support beam comprising an adjustable length and opposing ends and connectedly disposed to said side support brackets;

a lifting mechanism comprising a transmission shaft, said transmission shaft connecting said at least two cross support beams; and a power source connected to said transmission shaft capable of applying torque to said shaft.

89. The lifter of claim 88 wherein each said cross support beam is in proximate relationship with said upper end of two said side support brackets.

90. The lifter of claim 88 wherein each said cross support beam is disposed in a perpendicular relationship to said side support brackets.

91. The lifter of claim 88 wherein a height of said support brackets is adjustable.

92. The lifter of claim 88 wherein a length of said transmission shaft is adjustable.

93. The lifter of claim 88 comprising six side support brackets.

94. The lifter of claim 92 comprising three cross support beams.

95. The lifter of claim 88 additionally comprising side support beams attached in perpendicular planar configuration with said side support brackets.

96. The lifter of claim 95 wherein said side support beams are adjustably connected to said side support brackets wherein said overall length of said lifter is thereby adjustable.

97. The lifter of claim 88 wherein said side support brackets additionally comprise upper and lower cross beam guides adjacent said opening.

98. The lifter of claim 88 additionally comprising a side support bracket brace having a side support frame hole for receipt of a cross beam table width adjustment pin.

99. The lifter of claim 98 wherein said cross support beams comprise a plurality of adjustment holes disposed near each of said opposing ends for receipt of said cross-beam table width adjustment pin.

100. The lifter of claim 88 wherein said cross support beams and said side support brackets are foldable in a storage configuration.

101. The lifter of claim 88 wherein said lifting mechanism comprises:

at least one winch;

said transmission shaft disposed through said at least one winch;

a plurality of pulleys;

at least one cable running through each of said pulleys and through said at least one winch, said at least one cable having opposing ends; and at least one clamp or hook attached to at least one of said ends of each said cable.

102. The lifter of claim 101 wherein said transmission shaft is non-circular.

103. The lifter of claim 101 wherein said pulleys are comprise drop pulleys.

104. The lifter of claim 101 wherein said at least one clamp or hook comprises a spring loaded clamp or hook.

105. The lifter of claim 101 wherein said at least one winch is disposed at an approximate midpoint of at least one of said cross support beams.

106. The lifter of claim 105 wherein said plurality of pulleys are disposed at points on said cross support beams interposed between said midpoint of said cross support beams and a point of intersection of said cross support beams and said side support brackets.

107. The lifter of claim 106 wherein at least two pulleys are disposed on each said cross support beam.

108. The lifter of claim 101 wherein said at least one cable is disposed through said at least one winch and at least one pulley.

109. The lifter of claim 101 wherein said transmission shaft comprises a near end connected to said power source.

110. The lifter of claim 101 wherein said power source for torquing said shaft is selected from the group consisting of a motor and a manually generated force.

111. The lifter of claim 101 further comprising:

a worm gear disposed at a near end of said power transmission shaft;

a noncircular bore formed in said worm gear, said bore attachable to said transmission shaft in a manner to provide transfer of torque to said shaft;

a worm;

a crank handle having a crank end and a connection end, said handle attached to said worm at said connection end;

said worm positioned in relationship to said worm gear to transfer torque from said crank handle to said worm gear.

112. The lifter of claim 101 wherein said at least one winch comprises a double drum winch.

113. The lifter of claim 101 wherein one of said at least one winch disposed nearest said power source comprises a master winch.

114. The lifter of claim 101 wherein said at least one winch has an internal mechanism preventing reverse movement of said cable without engaging a manual release switch.

115. A lifter comprising:

at least four side support brackets each said side support bracket comprising an upper end and a lower end;

at least two cross support beams, each said beam comprising an adjustable length and opposing ends and connectedly disposed to said side support brackets;

a power source connected to said transmission shaft capable of applying torque to said shaft; and a lifting mechanism comprising:

a transmission shaft, said transmission shaft connecting said at least two cross support beams;

at least one winch;

said transmission shaft disposed through said at least one winch;

a plurality of pulleys;

at least one cable running through each of said pulleys and through at least one winch, said at least one cable having opposing ends; and at least one clamp or hook attached to at least one of said ends of each said cable.

116. The lifter of claim 115 wherein each said cross support beam is in proximate relationship with said upper end of two said side support brackets.

117. The lifter of claim 115 wherein each said cross support beam is disposed in a perpendicular relationship to said side support brackets.

118. The lifter of claim 115 wherein a height of said support brackets is adjustable.

119. The lifter of claim 115 wherein a length of said transmission shaft is adjustable.

120. The lifter of claim 115 comprising six side support brackets.

121. The lifter of claim 119 comprising three cross support beams.

122. The lifter of claim 115 additionally comprising side support beams attached in perpendicular planar configuration with said side support brackets.

123. The lifter of claim 122 wherein said side support beams are adjustably connected to said side support brackets wherein said overall length of said lifter is thereby adjustable.

124. The lifter of claim 115 wherein said side support brackets additionally comprise upper and lower cross beam guides adjacent said opening.

125. The lifter of claim 115 additionally comprising a side support bracket brace having a side support frame hole for receipt of a cross beam table width adjustment pin.

126. The lifter of claim 125 wherein said cross support beams comprise a plurality of adjustment holes disposed near each of said opposing ends for receipt of said cross beam table width adjustment pin.

127. The lifter of claim 115 wherein said cross support beams and said side support brackets are foldable in a storage configuration.

128. The lifter of claim 115 wherein said transmission shaft is non-circular.

129. The lifter of claim 115 wherein said pulleys comprise drop pulleys.

130. The lifter of claim 115 wherein said at least one clamp or hook is comprises a spring loaded clamp or hook.

131. The lifter of claim 115 wherein said at least one winch is disposed at an approximate midpoint of at least one of said cross support beams.

132. The lifter of claim 131 wherein said plurality of pulleys are disposed at points on said cross support beams interposed between said midpoint of said cross support beams and a point of intersection of said cross support beams and said side support brackets.

133. The lifter of claim 132 wherein at least two pulleys are disposed on each said cross support beam.

134. The lifter of claim 115 wherein said at least one cable is disposed through said at least one winch and at least one pulley.

135. The lifter of claim 115 wherein said transmission shaft comprises a near end connected to said power source.

136. The lifter of claim 115 wherein said power source for torquing said shaft is selected from the group consisting of a motor and a manually generated force.

137. The lifter of claim 115 further comprising:

a worm gear disposed at a near end of said power transmission shaft;

a noncircular bore formed in said worm gear, said bore attachable to said transmission shaft in a manner to provide transfer of torque to said shaft;

a worm;

a crank handle having a crank end and a connection end, said handle attached to said worm at said connection end;

said worm positioned in relationship to said worm gear to transfer torque from said crank handle to said worm gear.

138. The lifter of claim 115 wherein said at least one winch comprises a double drum winch.

139. The lifter of claim 115 wherein one of said at least one winch disposed nearest said power source comprises a master winch.

140. The lifter of claim 115 wherein said at least one winch has an internal mechanism preventing reverse movement of said cable without engaging a manual release switch.

* * * * *